United States Patent [19]

Eberhahn et al.

[11] Patent Number: 4,974,534

[45] Date of Patent: Dec. 4, 1990

[54] DOUBLE CHAIN STITCH SEWING MACHINE HAVING A LOOPER AND A LOOPER THREAD SPREADER

[75] Inventors: Gerhard Eberhahn; Ludwig Franz, both of Kaiserslautern, Fed. Rep. of Germany

[73] Assignee: Pfaff Industriemaschinen GmbH, Kaiserslautern, Fed. Rep. of Germany

[21] Appl. No.: 250,904

[22] Filed: Sep. 29, 1988

[30] Foreign Application Priority Data

Oct. 8, 1987 [DE] Fed. Rep. of Germany ..... 8713500
Sep. 29, 1988 [DE] Fed. Rep. of Germany ..... 8713060

[51] Int. Cl.[5] ..... D05B 1/10
[52] U.S. Cl. ..... 112/199; 112/166
[58] Field of Search ..... 112/165, 166, 197, 199

[56] References Cited

U.S. PATENT DOCUMENTS 966,431 8/1910 DeVoe ..... 112/165
2,482,079 9/1949 Zeier ..... 112/166 X
4,643,114 2/1987 Hampel et al. ..... 112/199

*Primary Examiner*—Wm. Carter Reynolds
*Attorney, Agent, or Firm*—McGlew and Tuttle

[57] ABSTRACT

A sewing machine with a housing having a base over which the workpiece is movable and with a drive shaft is rotatable in the housing. A needle bar is provided having a plurality of needles and is connected to the drive shaft and moved upwardly and downwardly. A feed mechanism is provided for moving the workpiece. A looper support has a looper for each needle and is connected to the drive shaft for swinging movement. A loop spreader connecting rod has a loop spreader for each needle and is movable transversely to the movement of the needles. A spreader drive shaft is connected to the drive shaft and has a drive crank eccentric which is oscillated by the rotation of the spreader drive shaft. An eccentric arm carried by the crank eccentric is connected to a rocking shaft via a clamp lever and the rocking shaft is connected to a crank which is connected to the connecting rod which carries the spreaders.

3 Claims, 2 Drawing Sheets

V
X
GF
NF

DOUBLE CHAIN STITCH SEWING MACHINE HAVING A LOOPER AND A LOOPER THREAD SPREADER

FIELD AND BACKGROUND OF THE INVENTION

A sewing machine of a similar construction is described in U.S. Pat. No. 2,482,079. The spreader has the function of pulling the thread out laterally as it issues from the region of the looper tip and as it runs upward to the stitch hole in such a way that the descending needle moves between the looper and the extracted lower thread. This process is generally referred to as tagging, i.e. entrance of the needle tip into a triangle formed by two sides of the upper thread and by the lower thread.

The drive of the connecting rod which carries the spreader is arranged perpendicular to the swinging direction of the looper and it is axially displaceable and parallel to the main shaft of the machine. The drive occurs in the known sewing machine from an eccentric secured on a shaft in drive connection with the arm shaft. The drive proceeds to a needle bearing through an eccentric rod in whose output end, designed as socket, a ball-shaped sleeve is mounted. A radial pin is guided through a bore of the sleeve and it is oriented parallel to the connecting rod and secured in a rocking shaft extending perpendicular to the connecting rod. The swinging motions imparted to the rocking shaft are transmitted to the connecting rod with a spreader via a crank arm secured on it. The crank arm has a radial pin which is guided in a bore of a cylindrical connecting pin for displacement in a fork head secured on the connecting rod. Thus, the connecting rod executes swinging motions perpendicular to the swinging direction of the looper.

Due to the oblique position of the radial pin relative to the axis of rotation of the drive eccentric in the ball-and-socket joint on the output side of the eccentric rod, which obliquity changes continually with the swinging motions of the rocking shaft, considerable transverse forces occur. The forces act above all on the needle bearing of the drive eccentric and cause intensive heating and high wear, necessitating frequent replacement repairs.

SUMMARY OF THE INVENTION

It is the object of the invention to design the drive parts for the connecting rod of the spreader so that the occurrence of harmful transverse forces is substantially eliminated.

According to the invention, the forces introduced into the gear train act only in directions perpendicular to each other and they are optimally supported in the bearing areas of the gear parts and are transmitted avoiding lateral components or with only a negligible lateral component.

Accordingly it is an object of the invention to provide a double chain stitch sewing machine in which a sewing machine needle bar carries a plurality of spaced apart needles which are associated with thread carrier loopers and which includes a drive for moving looper spreaders transversely to the feed direction for the purpose of spreading the needle thread off the loopers to form the chain stitch.

A further object of the invention is to provide a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

DESCRIPTION OF THE PREFERRED EMBODIMENTS

Figures 1, 2, 3, 5:
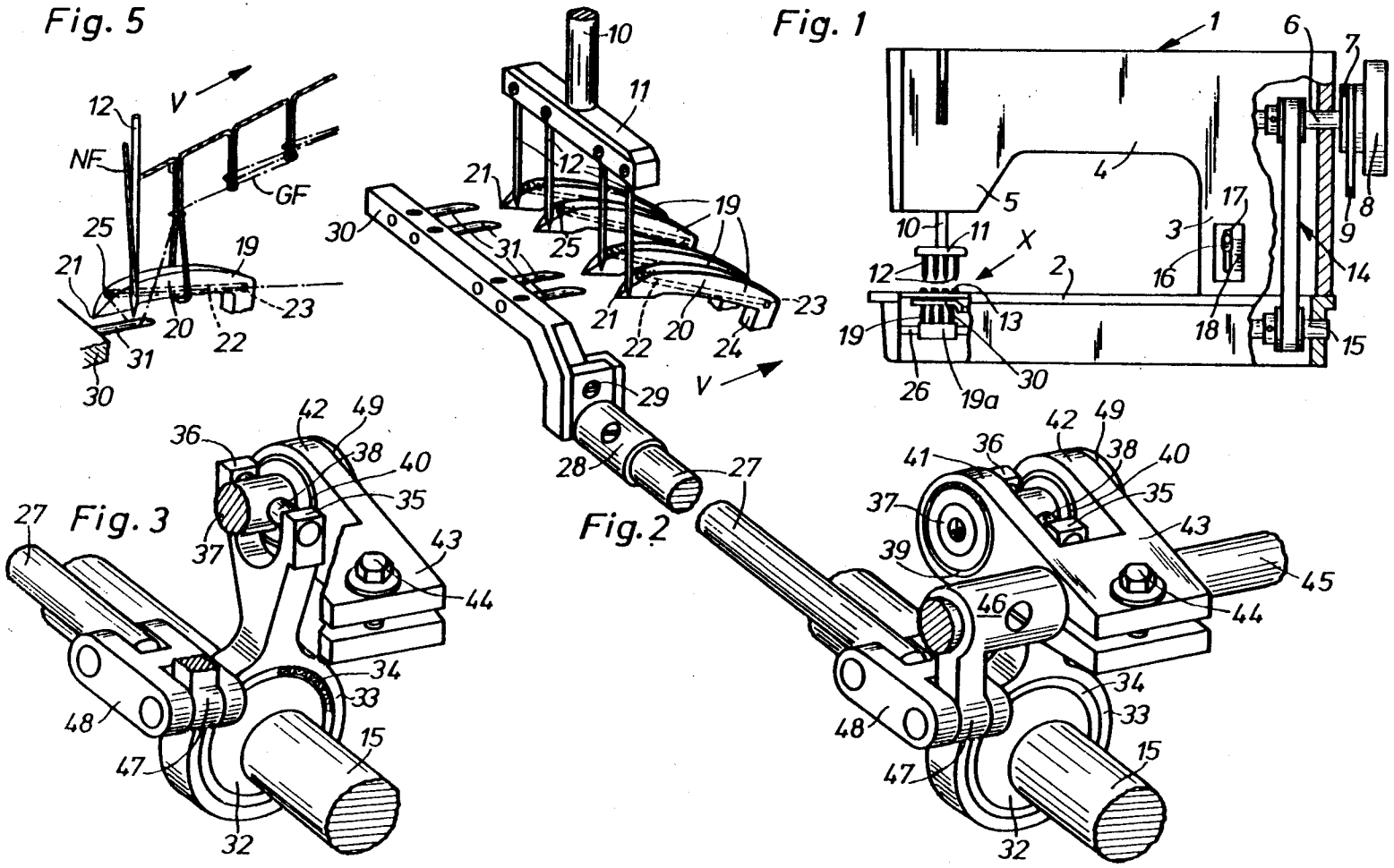
FIG. 1 is a front elevational view of a double chainstitch sewing machine constructed in accordance with the invention.
FIG. 2 is an exploded perspective view of a first embodiment of a spreader drive of the double chainstitch sewing machine according to the invention.
FIG. 3 is a perspective partial view of the spreader drive according to FIG. 2.
FIG. 5 is a schematic perspective view of the stitch formation of a double chainstitch seam, as seen in the direction of arrow V in FIG. 1.

Referring to the drawings in particular, the invention embodied therein comprises a double chain stitch sewing machine for sewing a workpiece and which comprises a sewing machine housing generally designated 1 which has a base plate 2 over which a workpiece is movable. A main drive shaft 6 is rotatable in the housing 1 and it is connected in the housing to a needle bar 10 which has a plurality of laterally spaced needles 12 which are moved upwardly and downwardly upon rotation of the drive shaft. A feed mechanism 13 is carried in the base 2 and acts on the workpiece to advance it in respect to the needle. In a looper carrier 19*a* a plurality of loopers 19 are fastened, each having a looper thread guide 22 for the looper thread GF. The loopers 19 are positioned to cooperate with the needles 12 during their upward and downward movement and carry out a swinging movement adjacent the path of movement of the needles 12. The connecting rod 27 forms a looper spreader carrier together with a support portion 30 carrying a plurality of spaced apart spreader elements 31. The connecting rod 27 is moved by a spreader drive shaft 15 which is driven by a gear belt 14 from the main drive shaft 6. The spreader drive shaft 15 carries an eccentric drive crank 33 which is oscillated by rotation of the shaft with an eccentric 32 and this driving action causes a moving of the spreaders 31 mounted on the support 30 relative to the needles 12 and in directions transverse to the workpiece feed direction. A spreader drive mechanism includes a clamp lever 43 linked to an eccentric rod 33 and which is clamped to a rocking shaft 45 swingingly driven by the eccentric 32. A crank 46 carried by the rocking shaft 45 is connected through a link 48 to the connecting rod 27 for producing the motion of the spreaders 31.

The sewing machine 1 has a base plate 2, to one end of which an upwardly extending standard 3 is screwed, which is formed with an arm 4 parallel to the base plate 2 and terminates in a head 5. Rotatably mounted in arm 4 is an arm shaft 6, one end of which protrudes from the standard 3 on which a pulley 7 and a hand wheel 8 are secured. Around the pulley 7 a belt 9 from the drive motor of the sewing machine is passed. The other end (not shown) of the arm shaft 6 ends in the head 5 and is provided in the usual manner with a crank (not shown) which serves via a gear train (not shown) to drive a needle bar 10 up and down. In the embodiment of FIG. 1 a needle holder 11 with four needles 12 is secured at the lower end of the needle bar 10. In known manner the needle bar 10 is swingingly driven in and counter to the feed direction, arrow V. In the standard 3 and in the base plate 2, a feed device (not shown) for the needle bar 10 and for the feed DOG 13 is provided. Such a feed device is described for example in U.S. Pat. No. 3,742,880.

The arm shaft 6 is in driving connection with a shaft 15 rotatably mounted in the base plate 2 via a toothed belt or gear belt drive 14 (transmission ratio 1:1).

For changing the feed or stitch length, a setting lever 16 of the feed device is brought to the outside through a slot 17 in the standard 3. Setting of the lever 16 is done with the aid of a scale 18.

Cooperating with each thread carrying needle 12 is a thread carrying looper 19 for the formation of a double chainstitch seam according to FIG. 5. Each looper 19 is formed with a looper blade 20 extending counter to the feed direction, arrow V; its free end forms a looper tip 21. To guide the looper thread (GF), the looper blade 20 has a U-shaped groove 22 which connects a bore 23 in the looper neck 24 with a bore 25 in the region of looper tip 21.

The loopers 19 are secured in a support 19*a* on a rocking shaft 26 mounted in the base plate 2 parallel to shaft 15. For the swinging drive of the loopers 19, shaft 15 is connected with the rocker shaft 26 via a transmission (not shown). A transmission of this type is described in the above named U.S. Pat. No. 3,742,880.

Displaceably mounted in the base plate 2 is a connecting rod 27 which extends parallel to shaft 15 and to the rocker shaft 26, at its end adjacent to the loopers 19, an upwardly projecting holding piece 29 provided with a hub 28 is secured. Screwed to the holding piece 29 is an angularly offset support 30, in which are inserted and screwed down a number of spreaders 31 for the looper thread (GF) corresponding to the number of loopers 19. For the drive of the connecting rod 27 an eccentric 32 secured on shaft 15 is used, which is surrounded by an eccentric rod 33 with interposition of a needle bearing 34. In the first embodiment illustrated in FIGS. 2 and 3, the output side of the eccentric rod 33 is of forked design with fork ends 35 and 36. It embraces a cylinder 37 with an unnumbered bore extending parallel to shaft 15, through which bore a sliding pin 38 secured in the fork ends 35, 36 is passed. Cylinder 37 is rotatably mounted in bearing webs 41, 42 of a lever 43, with interposition of rolling bearings 39 and 40, which lever is split and clamped by means of a screw 44 onto a rocking shaft 45 extending perpendicular to shaft 15 and mounted in the base plate 2. On one end of the rocking shaft 45 a crank 46 is secured, whose downwardly projecting crank arm 47 is articulated to the connecting rod 27 by a compensating link 48 of H-shaped design. To secure against axial displacement, an abutment disc 49 is screwed to each end face of cylinder 37.

Figure 4:
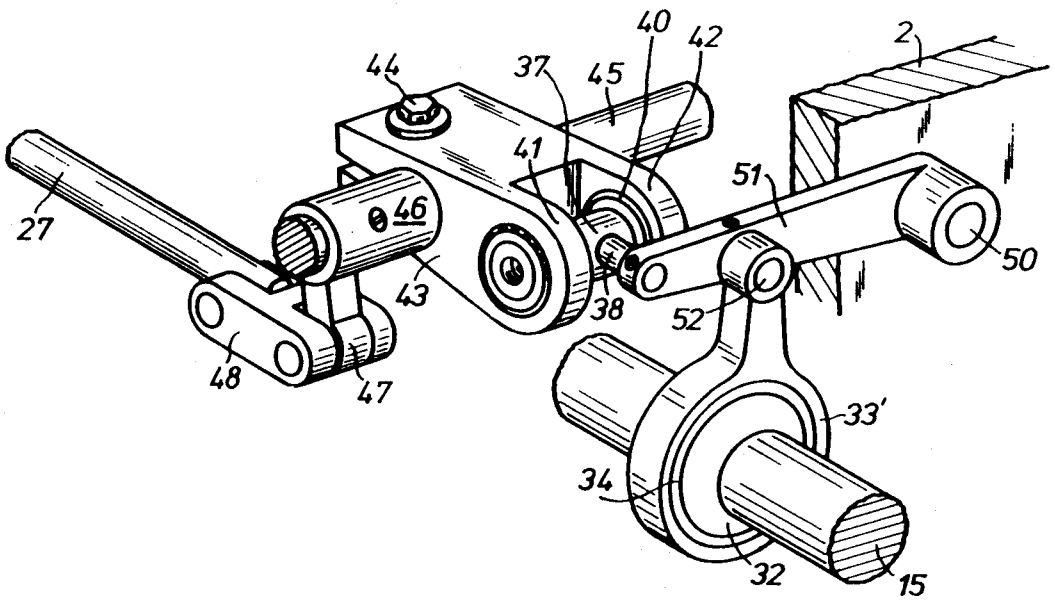
FIG. 4 is a partial perspective view of a second embodiment of the spreader drive.

In the second embodiment of the spreader transmission illustrated in FIG. 4, an output side of the eccentric rod 33' is articulatedly connected by a link bolt 52 with a rocking lever 51 mounted at one end in the base plate 2 by means of a link bolt 50 approximately in the center of lever 51. Fastened in the free end of rocking lever 51 is one end of the gliding pin 38, which is passed through the transverse bore of the of the cylinder 37 mounted in lever 43 with interposition of the rolling bearings 39, 40. In this design the abutment discs 49 are omitted.

Upon drive of the arm shaft 6, the needle bar 10 with the needles 12 secured in the needle holder 11 is moved up and down. Via the toothed belt drive 14 also shaft 15 is driven at a transmission ratio of 1:1. Depending on the setting of lever 16, as shaft 15 revolves, a quadrangle movement is imparted to the feeder 13 by the feed device, to advance the work in feed direction, arrow V, pressed by the usual presser foot (not shown) against the feeder 13.

During these movements, a swinging motion in and counter the feed direction, arrow V, is superposed on the needle bar 10 in such a way that advancing of the work takes place whenever the needles 12 have been inserted in the work. The needles 12 then enter a stitch hole provided in the webs of the feeder 13. The above described cooperation between the needles 12 and the feeder 13 during the sewing process is known for example from the previously cited U.S. Pat. No. 3,742,880.

By the rotary movement of shaft 15 the rocking shaft 26 with looper support 19*a* and the loopers 19 is swingingly driven through a transmission not shown (U.S. Pat. No. 3,742,880). Furthermore, in the first embodiment, the rocking shaft 45 extending perpendicular to shaft 15 is swingingly driven from the eccentric 32 via the needle bearing eccentric rod 33, the sliding pin 38, the cylinder 37 and the lever 43; and, in the second embodiment, from the eccentric 32 via the needle bearing eccentric rod 33', the rocking lever 51, the sliding pin 38, the cylinder 37 and the lever 43. In the gear trains 32 to 43 or 32 to 43 and 50 to 52 substantially no or only negligible transverse forces acting on the drive eccentric 32 occur, because the forces act in these gear trains in planes perpendicular to each other. The cylinder 37/pin 38 connection serves as a rotation translation compensating joint in the conversion of the movement of the eccentric rod 33' into the swinging motion of the lever 43 clamped on the rocking shaft 45.

The swinging motion of the rocking lever is transmitted to the connecting rod 27 by the crank 46 secured on it with crank arm 47 via the compensating link 48. With the connecting rod 27, the support 30 with the looper thread spreaders 31 executes a swinging motion perpendicular to the feed direction, arrow V, which motion has the same frequency as the motions of the loopers 19, needle bar 10, needles 12 and feeder 13.

The formation of a double chainstitch seam as schematically illustrated in FIG. 5 occurs in known manner by the fact that during its swinging motion counter to the work feed direction, arrow V, after the needle 12 has gone through its lower reversal point and has moved upward a short distance, thus causing formation of an upper thread loop, the looper 19 will enter into this loop. The spreader 31 seizes the looper thread (GF), which has come out of the bore 25 and reaches the stitch hole, and pulls it out to the side, so that a "thread triangle" is exhibited. The thread triangle is bounded by the looper thread (GF), the looper thread piece lying in the groove 22 of the looper blade 20, and the leg of the upper thread loop lying around the looper blade 20. The descending needle 12 enters for the "tap" into the thus formed thread triangle, whereupon the spreader 19 releases the looper thread (GF) and the stitch is pulled tight by the usual thread take-up lever after the looper 19 has come out of the upper thread loop.

While specific embodiments of the invention have been shown and described in detail to illustrate the application of the principles of the invention, it will be understood that the invention may be embodied otherwise without departing from such principles.

What is claimed is:

1. A double chainstitch sewing machine, comprising a drive shaft, a looper swingably drivable in a feed direction connected to said drive shaft, a spreader for the looper thread swingably drivable crosswise to the feed direction of said sewing machine, said spreader having a connecting rod carrying said spreader, an eccentric secured on said drive shaft arranged parallel to said spreader and driving said spreader via an eccentric rod, an intermediate rocking shaft, a lever secured on said intermediate rocking shaft disposed adjacent to said drive shaft, a cylinder rotatably disposed perpendicular to said drive shaft on said lever, linkage means connecting said intermediate rocking shaft to said spreader, said cylinder having a transverse bore, and a sliding pin slidable in said bore and connected to said eccentric rod on an output side of said eccentric rod.

2. A double chain stitch sewing machine according to claim 1, wherein said output side of said eccentric rod comprises a fork-shaped member receiving said sliding pin.

3. A double chainstitch sewing machine according to claim 1, wherein said output side of said eccentric rod is connected to said sliding pin via a rocking lever, said rocking lever being mounted at one end of a fixed axle, said sliding pin being secured in a free end of said lever.

* * * * *